United States Patent [19]

Wixon

[11] 4,304,680

[45] Dec. 8, 1981

[54] LAUNDRY SOAP

[75] Inventor: Harold E. Wixon, New Brunswick, N.J.

[73] Assignee: Colgate-Palmolive Company, New York, N.Y.

[21] Appl. No.: 841,919

[22] Filed: Oct. 13, 1977

Related U.S. Application Data

[63] Continuation of Ser. No. 622,570, Oct. 15, 1975, abandoned, which is a continuation of Ser. No. 513,606, Oct. 10, 1974, abandoned, which is a continuation of Ser. No. 329,354, Feb. 5, 1973, abandoned.

[51] Int. Cl.[3] ..... C11D 1/29; C11D 9/12; C11D 10/04; C11D 17/08

[52] U.S. Cl. ..... 252/114; 252/109; 252/121; 252/122; 252/132; 252/173; 252/174.14; 252/532; 252/551; 252/DIG. 14

[58] Field of Search ..... 252/109, 110, 111, 117, 252/121, 532, 551, 173, DIG. 14, 114

[56] References Cited

U.S. PATENT DOCUMENTS

| | | | |
|---|---|---|---|
| 2,527,075 | 10/1950 | Preston | 252/121 |
| 3,085,982 | 4/1963 | Steer | 252/532 X |
| 3,179,599 | 4/1965 | Eaton | 252/153 |
| 3,414,520 | 12/1968 | McDonnell | 252/110 |
| 3,586,632 | 6/1971 | Hewitt | 252/117 |
| 3,707,503 | 12/1972 | Kenney | 252/117 |
| 3,850,834 | 11/1974 | Hellsten | 252/117 |
| 3,959,165 | 5/1976 | Yurko | 252/109 |
| 4,009,114 | 2/1977 | Yurko | 252/109 |
| 4,013,577 | 3/1977 | Wixon | 252/109 |
| 4,028,262 | 6/1977 | Cheng | 252/89 |

FOREIGN PATENT DOCUMENTS

| | | | |
|---|---|---|---|
| 945062 | 12/1963 | United Kingdom | 252/121 |

OTHER PUBLICATIONS

Schönfeldt, N: "The Action of Various Lime Soap Dispersants," *J. Am. Oil Chemists' Soc.*, vol. 45, Feb. 1969, pp. 80–82.

*Primary Examiner*—Dennis L. Albrecht
*Attorney, Agent, or Firm*—Kenyon & Kenyon

[57] ABSTRACT

Laundry soap performance in hard water can be substantially improved by incorporating an alcohol polyethoxy sulfate and an alkali metal carbonate, alkali metal silicate, or mixtures thereof, into the soap formulation. Additional builder salts may be added to the formulations. The soap formulations may be either liquids or dry formulations.

1 Claim, No Drawings

LAUNDRY SOAP

This is a continuation of application Ser. No. 622,570 filed Oct. 15, 1975; which is a continuation of application Ser. No. 513,606 filed Oct. 10, 1974; which is a continuation of application Ser. No. 329,354 filed Feb. 5, 1973 all now abandoned.

BACKGROUND OF THE INVENTION

The present invention relates to soap formulations which do not form a scum in hard water.

The oldest, best known, or by far the most important surface active agents are soaps. The salient disadvantage of the soaps is their instability toward heavy-metal ions, particularly the calcium and magnesium ions found in hard water, as the calcium and magnesium salts of the fatty acids are quite insoluble in water. Soap, however, has at least two major points of superiority, i.e., low cost and high detergent powers in most of the cleaning operations encountered practically.

Fatty acid soaps in moderately hard water are known to provide excellent soil removal and very good suspension of soil in the wash cycle of laundering if sufficient quantities of soap are used. However, in the subsequent step of rinsing, a smaller amount of residual soap, which cannot be totally extracted from the laundry items, comes into contact with a relatively large amount of hard water cations. This rinsing step can reprecipitate lime soap, carrying with it small but ultimately visible amounts of insoluble dirt and other "color bodies".

Thus, in hard water, soap is less economical to use than detergents because a much higher concentration of soap is required to titrate the hardness. Soap is also poorly soluble in cool water, making it undesirable for use in washing many delicate synthetic fabrics as well as some colored fabrics, the colors of which may bleed in hot water.

SUMMARY OF THE INVENTION

The problems associated with use of soap in hard water, namely the formation of soap curd which deposits on clothes, can be largely eliminated by the incorporation of an alcohol polyethoxy sulfate and a suitable detergency builder into the soap composition. The alcohols polyethoxy sulfate plus builder salt combination is hard water resistant, and therefore substantially improves soap detergency in hard water, as well as effectively preventing soap curd formation, even in the hardest water, e.g., 600ppm. hardness.

In the broadest sense, the laundry soap composition of the present invention comprises from about 20 to 80% of a water-soluble soap, from about 3 to about 30% of a higher fatty alkyl polyethoxy sulfate of the formula $RO(C_2H_4O)_nSO_3M$, wherein R is a fatty alkyl group of from 10 to 20 carbon atoms, n is a number from 2 to 6, n being from 1/5 to 1/3 of the number of carbon atoms in R, and M is a solubilizing, salt-forming cation such as alkali metal, ammonium, lower alkylamino or lower alkanolamino; and from about 5% to about 40% by weight of a builder selected from alkali metal carbonates and alkali metal silicates, as well as soluble silicates, oxydiacetates, iminodiacetates, polycarboxylates, etc.

The instant laundry soap compositions may be prepared using any type of soap, including mixtures of fatty acid soaps. Suitable soaps include the water-soluble soaps such as sodium, potassium, and other suitable alkali metal and ammonium soaps which may be prepared from tallow, hydrogenated tallow, grease, coconut oil, hydrogenated coconut oil, cottonseed oil, soybean oil, corn oil, olive oil, palm oil, peanut oil, and the like. These soaps usually comprise the water-soluble salts of higher fatty acids of about 12 to 20 carbon atoms. Soaps of fatty acids derived from synthetic sources may also be used.

The alcohol polyethoxy sulfate used in the laundry soap compositions of the present invention has the formula $RO(C_2H_4O)_nSO_3M$, wherein R is a fatty alkyl group having from about 10 to 20 carbon atoms, n is a number from 2 to 6, n being from 1/5 to $\frac{1}{3}$ of the number of carbon atoms in R, and M is a solubilizing, salt-forming cation such as sodium, potassium, ammonium, lower alkylamino, lower alkanolamino, etc. This anionic detergent is mostly readily biodegradable and has better detergency when the fatty alkyl group is terminally joined to the polyoxyethylene chain which, of necessity, is also terminally joined to the sulfur in the sulfate group. Although a slight amount of branching of the higher alkyl group may be tolerated, to the extent of not more than 10% of the carbon atom content of the alkyl not being in a straight carbon chain, generally even this minor deviation from linear structure is to be avoided. Also, medial joinder of the alkyl to the ethoxy chain should be minimal, i.e., less than 10%, and even such joinder should preferably be concentrated near the end of the alkyl chain. Within the 10 to 20 carbon atom alkyl groups, the preferred alkyls are of 12 to 15 carbon atoms, and those most preferred are the mixed alkyls containing 12, 13, 14 and 15 carbon atom chains. The mixture is preferably one with at least 10% of each chain length and no more than 50% of any one chain length.

The ethylene oxide content of the anionic detergent is such that n is from 2 to 6 and preferably from 2 to 4 and generally averaging about 3, especially when R is mixed 12–15 carbon atom alkyl mixture. To maintain a desired hydrophilic-lipophilic balance when the carbon content of the alkyl chain is in the lower portion of the 10–20 range, the ethylene oxide content might be reduced so that n is about 2, whereas when R is in the range of from 16 to 18 carbon atoms, n may be within the range of from 4 to 6.

The salt-forming cation may be any suitable solubilizing metal or radical, but will most frequently be an alkali metal cation or an ammonium cation. If alkylamine or lower alkanolamine groups are present, alkyls and alkanols thereof usually contain 1 to 4 carbon atoms and the amines and alkanolamines may be mono-, di-, or tri-substituted, i.e., monoethanolamine, diisopropanolamine, trimethylamine, etc.

Choice of the proper alcohol polyethoxy sulfate is important in obtaining maximum detergency from the instant laundry soap compositions. Even within the preferred range of alcohol polyethoxy sulfates, an improvement in detergency is noted for compositions which include a mixed 12–15 carbon atoms alcohol polyethoxy sulfate when compared to other higher alkyl ethoxy sulfates such as a mixed 14–15 carbon atoms polyethoxy sulfate of the same ethoxy chain length. The preferred detergent is available from Shell Chemical Company and identified by them as Neodol 25-3S, the sodium salt normally sold as a 60% active material including about 40% of the aqueous solvent medium, of which a minor proportion is ethanol. Although this material is the sodium salt, the potassium and other suitable soluble salts may be utilized either in partial or complete substitution for the sodium salt.

Examples of the higher alcohol polyethoxy sulfates which may be utilized in the laundry soap compositions of the present invention include: mixed $C_{12-15}$ normal primary alkyl triethenoxy sulfate, sodium salt; myristyl triethenoxy sulfate, potassium salt; n-decyl diethenoxy sulfate, diethanolamine salt; lauryl-diethenoxy sulfate, ammonium salt; palmityl tetraethenoxy sulfate, sodium salt; mixed $C_{14-15}$ normal primary alkyl mixed tri- and tetraethenoxy sulfate, sodium salt; stearyl pentaethenoxy sulfate, trimethylamine salt; and mixed $C_{10-18}$ normal primary alkyl triethenoxy sulfate, potassium salt. Minor proportions of the corresponding branched chain and medially alkoxylated detergents, such as those described above but modified to have ehtoxylation at a medial carbon atom, e.g., one located four carbons from the end of the chain, may be employed, but the carbon atom content of the higher alkyl group will be the same. Similarly, the joinder of a normal alkyl group may be at a secondary carbon atom one or two carbon atoms removed from the end of the chain. In either case, only the minor proportions previously mentioned will be present.

The composition of the present invention also includes at least one builder selected from the following: alkali metal silicates, carbonates, citrates, oxydiacetates, polycarboxylates, hydroxyethyl iminodiacetates, and mixtures thereof, and preferably silicates and carbonates. The builders are used in the compositions of the present invention to enhance detergency in hard water as well as in cool water.

The water-soluble silicates which may be utilized as builders in the present composition are alkaline materials which also function as anti-corrosion or protective additives and are particularly helpful in removing particulate soil from the laundry and preventing harm to ceramic, porcelain, vitreous, aluminum, and steel parts of washing machines, similar equipment, and laundered items.

Although various soluble silicates may be utilized providing that their alkalinities are sufficient to aid in building and anti-corrosion functions, those which are most effective and readily available are the alkali metal silicates, especially those wherein the $Na_2O:SiO_2$ or $K_2O:SiO_2$ ratios are within the range of 1:1.5 to 1:2.5. Particularly useful as the alkali metal silicates, i.e., sodium silicates, wherein the ratios are 1:1.6 or 1:2.35. It will be apparent that the lower the ratio the higher the alkalinity of the silicate and, therefore, when it is desired to raise the alkalinity, the average $Na_2O:SiO_2$ ratio will be increased. Other silicates within the described broad range may be utilized either alone or in mixtures depending on the particular soap compositions and the compatibility of the various other constituents. Although silicates having ratios outside the 1:1.5 to 1:2.5 range may be utilized, such as those of ratios of 1:1 and 1:3, generally the proportions of such silicates will be minor, being generally less than 10% of the total content. Both the sodium and potassium silicates are useful as building agents in the laundry soap compositions of the present invention.

The carbonates utilized may be utilized either in their usual hydrated form or as soda ash; when a lower pH is desired, the bicarbonates may be utilized. The carbonates, in addition to contributing to the detergency of the formulation, aid in saponifying fatty acid soils, thus aiding in removal of such soils. The carbonates also tie up the hardness ions of $Ca^{+2}$ and $Mg^{+2}$ present in the wash water.

Where carbonates are used as builders in the instant laundry soap compositions, it is desirable to have good suspension of the resulting calcium carbonate precipitate in the wash water, in order to minimize adsorption of calcium carbonate onto fabric substrates and thus decrease fabric "boardiness". Calcium carbonate precipitates can be retarded during the normal wash cycle if an optimal weight of carbonate to citrate is employed. It was found that this ratio is ideally equal to or less than 2 under average hard water washing conditions of water of 150 ppm. hardness at 40° C. The necessary ratio will decrease with increases in temperature and water hardness. A relatively lower level of citrate, e.g., between about 5% and about 15% sodium citrate, was found to delay calcium carbonate precipitation until the later stage of the washing cycle and not to complete the precipitation during the washing cycle. It can also do much to improve the suspension of calcium carbonate which does precipitate (its particle size becomes fine and its surface charge increases). These functions will decrease the adsorption of calcium carbonate onto laundered fabric.

The preferred oxydiacetate salt for use in the instant soap composition is monosodium oxydiacetate, although other water-soluble salts of oxydiacetic acid can also be used. Examples thereof are disodium oxydiacetate, other alkali metal and ammonium salts of oxydiacetic acid, and alkylolamine salts of oxydiacetic acid.

Monosodium oxydiacetate is of particular value in the instant soap compositions because of its sequestering ability, which is the removal of an ion without precipitation or adsorption. From a practical point of view, the sequestering action of monosodium oxydiacetate is similar to that of the condensed polyphosphates, and in many cases the two substances produce substantially the same effect. Monosodium oxydiacetate has one great advantage over the condensed phosphates in that it does not tend to decompose or hydrolyze in aqueous solution, and therefore can be used sucessfully as an ingredient in aqueous formulations.

Laboratory tests indicate that monosodium oxydiacetate is less corrosive to copper and galvanized steel than sodium tripolyphosphate and trisodium nitrilotriacetate. Results of biodegradation tests show that monosodium oxydiacetate can be oxidized readily by microorganisms.

Other builders that can be used in the soap compositions of the present invention include alkali metal borates, phosphates, polyphosphates, and bicarbonates. Specific examples of such salts are sodium and potassium tetraborates, bicarbonates, tripolyphosphates, pyrophosphates, orthophosphates, and hexametaphosphates.

Examples of suitable organic alkaline detergency builder salts which can be used include water-soluble aminopolycarboxylates (e.g., sodium and potassium ethylenediaminetetraacetates, nitrilotriacetates, and N-(2-hydroxyethyl)-nitrilo diacetates); water-soluble salts of phytic acid; water-soluble salts of ethane-1-hydroxy-1, 1-diphosphonate; water-soluble salts of methylene diphosphonic acid; water-soluble salts of substituted methylene diphosphonic acids; water-soluble salts of polycarboxylate polymers and copolymers (e.g., a water-soluble salt of a polymeric aliphatic polycarboxylic acid having the following structural relationships as to the position of the carboxylate groups and possessing the following physical characteristics: a minimum molecular weight of about 350 calculated as to the acid form; an equivalent weight of about 50 to about 80 calculated as to the acid form; at least 45 mole percent of the monomeric species having at least two carboxyl radicals separated from each other by not more than two carbon atoms; the site of attachment to the polymer chain of any carboxyl-containing radical being separated by not more than three carbon atoms along the polymer chain from the site of attachment of the next carboxyl-containing radical. Specific examples are polymers of itaconic acid, aconitic acid, maleic acid, mesaconic acid, fumaric acid, methylene malonic acid, and citraconic acid and copolymers with themselves and other compatible monomers such as ethylene).

Where a liquid formulation is desired, it is preferred to use potassium soaps and potassium builder salts, which are more soluble in water. Depending on the proportions of soap, alcohol polyethoxy sulfate, and solubilizers and hydrotropes used, a clear liquid, an opaque liquid, or a multi-phase liquid may be obtained.

The preferred soaps for use in liquid detergent compositions according to the present invention are potassium oleate, potassium tallowate, and potassium cocoate. Potassium oleate is the soap of preference because of its greater water solubility. The concentration of soap in the liquid formulations can range from about 100% to about 50%.

The alcohol polyethoxy sulfates for use in the liquid compositions of the present invention are the same ones as used in the dry formulations. The alcohol polyethoxy sulfates are present in the liquid soap products in amounts ranging from about 1.0% to about 20%.

The preferred builders for use in the liquid compositions are mixtures of the alkali metal silicates having a $Na_2O:SiO_2$ ratio ranging from about 1:1.15 to about 1:2.5, and the alkali metal carbonates, including alkali metal bicarbonates, and alkali metal sesquicarbonates. The silicates and the carbonates are each present in the liquid soap compositions in amounts ranging from about 1% to about 15%. Additional builders, as described for dry soap compositions of the present invention, may be present in amounts ranging from about 1% to about 15%.

The inclusion of a water-soluble hydrotropic substance is effective in promoting the compatibility of the ingredients so as to form a homogeneous liquid product. Suitable materials are the alkali metal organic sulfonated (including sulfated) salts having a lower alkyl group of up to about six carbon atoms. It is preferred to employ an alkyl aryl sulfate having up to six carbon atoms in the lower alkyl group such as the sodium and potassium xylene, toluene, ethylbenzene, and isopropyl benzene sulfonates. Sulfonates made from xylene include orthoxylene sulfonates, metaxylene sulfonate, paraxylene sulfonate, and ethylbenzene sulfonate as the main ingredient. Analyses of typical commercial products show about 40–50% metaxylene sulfonate, 10–35% orthoxylene sulfonate, and 15–30% paraxylene sulfonate, with 0–20% ethylbenzene sulfonate. Any suitable isomeric mixture may be employed; however, sodium and potassium alkyl naphthalene sulfonates having up to six carbon atoms in the lower alkyl group may also be used. Suitable lower alkyl sulfate salts having about fix to six carbon atoms in the alkyl group may be employed also, such as the alkali metal n-amyl and n-hexyl sulfates. The hydrotropic materials are employed generally in amounts ranging from about 5% to about 25% by weight of the composition.

Organic solvents are present in the liquid soap compositions of the present invention to work in conjunction with the hydrotrope in solubilizing the active ingredients. The organic solvents help to impart a clear, readily-flowing property to the soap compositions. Among the organic solvents found to be particularly beneficial in the formulations of the present invention are ethanol, propanol, isopropanol, propylene glycol, and the like. The solvents provide for improved physical properties such as a lower cloud point, improved low temperature aging, modified viscosity, and the like. The suitable amount of solvent which may be employed varies with the particular formulation, as an excessive amount tends to result in separation of the product into two or more phases. The organic solvents are generally present in amounts ranging from about 5% to about 25%, and preferably from about 10% to about 15%.

Where a more viscous liquid soap formulation is desired, it is possible to add a synthetic polymer type anti-redeposition agent to the formulation. Sodium carboxymethylcellulose is by far the best known and most widely used anti-redeposition agent; it usually has a substitution value of 0.6 to 0.7, i.e., approximately two etherified hydroxyl groups are present for every three anhydroglucose units. Many other hydrophilic colloids, particularly those which are polyelectrolytes, are useful as soil-suspending agents in the soap formulations of the present invention, in the dry formulations as well as in the liquid formulations. The alginates, Irish moss, and the various vegetable gums have a valuable soil-suspending action. Carboxyethylcellulose, prepared by adding acrylonitrile to alkali cellulose and hydrolyzing the nitrile group, has been found useful as a soil-suspending agent, as well as several other cellulose derivatives which are known to be emulsifying agents and protective colloids as well. Among these materials are sulfoethylcellulose (made by adding vinylsulfonic acid to alkali cellulose), hydroxyethylcellulose, and methylcellulose. Carboxymethyl ethers of starch as well as the water-soluble methyl and hydroxyethyl ethers of starch can also be used as soil-suspending agents in the formulations of the present invention. Carboxymethyl starch can be prepared by treating starch with chloroacetic acid and sodium hydroxide in aqueous methanol. Polyvinyl alcohols, polyvinylpyrrolidones, and polyethylene glycols are among the synthetic polymers useful as antiredeposition agents in the present formulations. Polyvinylpyrrolidones of molecular weight of 15,000 to 40,000 are very effective whereas the higher polymers of molecular weight of 50,000 and upwards have very little soil-suspending action. Polyethylene glycols of molecular weight of 6,000 or higher are very effective, although the soil-suspending effect decreases with decrease in the molecular weight. Among the polyvinyl alcohols the products of lower molecular weight and low degree of hydrolysis (77% hydrolyzed from the polyvinylacetate starting material) are much more effective soil-suspending agents than the higher molecular weight, fully hydrolyzed materials.

The liquid soap formulations of the present invention exhibit many desirable characteristics with regard to both physical properties and performance in use. As to physical properties, the formulations are pourable and free-flowing from the container as manufactured and after aging. They exhibit a high degree of stability upon storage at normal room temperature of the order of about 70° F. over a period of many months without any appreciable precipitation. As a result, the consumer can utilize them conveniently by addition of small portions to a dishpan or laundering bath and the formulation will be present in constant composition in each portion. While adjuvant materials may be added which render the final solution transparent or opaque as desired, the requirement for a clear solution of the main ingredients insures that effective washing power will be obtained with each portion, and promotes the stability and homogeneity of the product. The liquid may be packaged in any suitable container of packaging material such as metal, plastic, or glass in the form of bottles, bags, cans, or drums.

Various adjuvant materials may be added to the soap formulations of the present invention, including optical brighteners, bleaches, germicides, fungicides, bactericides, colorants, perfumes, etc., which do not interfere with the detergency of the formulation.

In performance, the products of the present invention exhibit a particularly high level of washing power during dishwashing, laundering, and other cleaning operations.

DESCRIPTION OF THE PREFERRED EMBODIMENTS

The following examples are further illustrative of the present invention, and it will be understood that the invention is not limited thereto.

Example I

A laundry soap was prepared from the following ingredients:

| | percent by weight |
|---|---|
| Sodium soap, 83% Tallow/17% Coco | 40.00 |
| Alcohol polyethoxy sulfate*, sodium salt | 10.00 AI |
| Sodium carbonate | 10.00 |
| Sodium silicate, 1:2.35 $Na_2O:SiO_2$ | 10.00 |
| Optical brighteners | 1.05 |
| Perfume | 0.15 |
| Sodium sulfate | 18.80 |
| Water | 10.00 |

*$C_{12}$–$C_{15}$ alcohol, ethoxylated with 3 moles of ethylene oxide.

The efficacy of this composition was demonstrated in the following Tergotometer detergency tests, using three soils. The products tested were used at 0.15% product concentration in water of 150 ppm. hardness at 120° F.

The soiled swatches used were prepared as follows:

Spangler Synthetic sebum/particulate soil was applied to 100% cotton swatches from a water emulsion and allowed to dry. Piscataway, New Jersey, Research Center Particulate (sieved top soil) was applied dry to a 50% polyester/50% cotton blend with a permanent press finish. Bandy Black clay, obtained from H. C. Spinks Co., was applied to cotton from a water suspension and dried.

The cleaning products used were the following:

A—40% soap, 10% sodium carbonate, 10% sodium silicate, QS $H_2O$

B—50% soap, 10% sodium carbonate, 10% sodium silicate, QS $H_2O$

C—65% soap, 10% sodium carbonate, 10% sodium silicate, QS $H_2O$

D—Soap formulation of Example I

The results of the tests are shown in the following table:

| Composition | Spangler Soil ΔRd* | Research Center Particulate Post-Wash Rd* | Bandy Black Clay, ΔRd* |
|---|---|---|---|
| A | 11.5 | 58.6 | 6.2 |
| B | 15.8 | 57.3 | 7.0 |
| C | 19.9 | 58.7 | 10.6 |
| D | 20.5 | 75.5 | 14.1 |

*whiteness as measured on a Gardner Color Difference Meter of a combination of soap and polyethoxy alcohol sulfate to even increased concentrations of soap in moderately hard water.

EXAMPLE II

A laundry soap was prepared from the following ingredients:

| | percent by weight |
|---|---|
| Sodium soap, 83% Tallow/17% Coco | 30.00 |
| Alcohol polyethoxy sulfate*, sodium salt | 15.00 |
| Sodium carbonate | 10.00 |
| Sodium silicate, 1:2.35 $Na_2O:SiO_2$ | 15.00 |
| Optical brighteners | 1.05 |
| Perfume | 0.15 |
| Sodium sulfate | 18.80 |
| Water | 10.00 |

*$C_{12}$–$C_{15}$ alcohol, ethoxylated with 3 moles of ethylene oxide

A 0.15% concentration this soap composition foams very well in water up to at least 600 ppm. hardness at both room temperature and 120° F. with no curd formation. Spangler particulate soil detergency is satisfactory in water at both room temperature and at 120° F.

EXAMPLE III

A test was performed to compare the soap composition of the present invention with laundry soap alone. The two formulations compared were as follows:

| | | |
|---|---|---|
| A: | Soap (83% Tallow, 17% Coco) | 65% |
| | Sodium carbonate | 10% |
| | Sodium silicate | 10% |
| | Fillers, water | q.s. |
| B: | Soap (83% Tallow, 17% Coco) | 40% |
| | Alcohol polyethoxy sulfate ($C_{12}$–$C_{15}$ alcohol, ethoxylated with 3 moles of ethylene oxide) | 10% |
| | Sodium carbonate | 10% |
| | Sodium silicate | 10% |
| | Fillers, water | q.s. |

A clean load of all dark fabrics was placed into a General Electric washer, water was added, and the product was dispensed via the washer's filter tray. In all cases the wash water temperature was 120° F., and the cleaner concentration was 0.15%. Water having hardness of 150 ppm. and 250 ppm. as well as Piscataway, N.J. tap water having hardness of about 100 ppm. was used for the tests. The fabrics were then examined for soap residues. The results are tabulated below:

| Water Hardness | Wash # | Product | Rinse Temp. | Residue |
|---|---|---|---|---|
| Piscataway, New Jersey Tap | 1 | A | 80° F. | Heavy |
| | | B | 66° | None |

-continued

| Water Hardness | Wash # | Product | Rinse Temp. | Residue |
|---|---|---|---|---|
| | 2 | A | 66° | Moderate |
| | | B | 80° | Very slight |
| 150 PPM | 1 | A | 90° | Very heavy |
| | | B | 65° | None |
| | 2 | A | 65° | Very heavy |
| | | B | 87° | None |
| 250 PPM | 1 | A | 85° | Very heavy |
| | | B | 66° | None |
| | 2 | A | 70° | Moderate |
| | | B | 90° | None |

The data presents conclusive evidence that the composition of the present invention is superior to plain laundry soap with builders. Generally, no residue was found, despite the various rinse temperatures and water hardnesses.

EXAMPLE IV

A liquid soap formulation is made up from the following ingredients:

| | percent by weight |
|---|---|
| Potassium oleate | 20.00 |
| Alcohol polyethoxy sulfate*, potassium salt | 5.00 |
| Potassium carbonate | 10.00 |
| Potassium silicate 1:2.10 $K_2O:SiO_2$ | 10.00 |
| Trisodium citrate | 10.00 |
| Ethanol | 5.00 |
| Potassium xylene sulfonate | 5.00 |
| Optical brighteners | 1.05 |
| Carboxymethylcellulose | 1.00 |
| Perfume | 0.15 |
| Water | 32.80 |

*$C_{12}$-$C_{15}$ alcohol, ethoxylated with 3 moles of ethylene oxide

EXAMPLE V

A liquid soap composition is formulated as follows:

| | percent by weight |
|---|---|
| Potassium soap, 83% Tallow/17% Coco | 15.00 |
| Alcohol polyethoxy sulfate*, potassium salt | 10.00 |
| Potassium sesquicarbonate | 15.00 |
| Potassium silicate, 1:2.10 $K_2O:SiO_2$ | 10.00 |
| Isopropanol | 10.00 |
| Potassium xylene sulfonate | 8.00 |
| Optical brighteners | 1.05 |
| Perfume | 0.15 |
| Water | 30.80 |

*$C_{12}$-$C_{15}$ alcohol, ethoxylated with 3 moles of ethylene oxide

EXAMPLE VI

A liquid soap composition is formulated from the following ingredients:

| | percent by weight |
|---|---|
| Potassium oleate | 45.00 |
| Alcohol polyethoxy sulfate*, potassium salt | 15.00 |

-continued

| | percent by weight |
|---|---|
| Potassium silicate, 1:2.10 $K_2O:SiO_2$ | 5.00 |
| Monosodium oxydiacetate | 5.00 |
| Ethanol | 5.00 |
| Potassium xylene sulfonate | 2.00 |
| Optical brighteners | 1.05 |
| Carboxymethylcellulose | 1.00 |
| Perfume | 0.15 |
| Water | 15.80 |

*$C_{12}$-$C_{15}$ alcohol, ethoxylated with 3 moles of ethylene oxide

A bundle test was performed to compare the performance of the soap compositions of the present invention with a conventional laundry soap formulation. The formulations tested are as follows:

| | | percent by weight |
|---|---|---|
| Product A: | Soap (83% Tallow, 17% Coco) | 40.00 |
| | Alcohol polyethoxy sulfate* | 10.00 |
| | Sodium carbonate | 10.00 |
| | Sodium silicate | 10.00 |
| | Brighteners | 1.05 |
| | Water, fillers, etc. | q.s. |
| Product B: | Soap (83% Tallow, 17% Coco) | 65.00 |
| | Sodium carbonate | 10.00 |
| | Sodium silicate | 10.00 |
| | Brighteners | 1.05 |
| | Water, fillers, etc. | q.s. |

*$C_{12}$-$C_{15}$ alcohol ethoxylated with 3 moles of ethylene oxide

The products were used at 0.15% concentration in water of 150 ppm. hardness at 120° F. The laundry bundles, weighing eight pounds each, were composed of cotton and easy care fabrics (polyester/cotton and nylon). The fabrics were dryer-dried and compared for cleanness under simulated north daylight and incandescent light (Mac Beth Examolite). The preferences of 10 panelists are tabulated below in terms of percent of votes.

| | North Daylight | | |
|---|---|---|---|
| | Product A | Product B | No Preference |
| Cotton | 69 | 19 | 12 |
| Easy Care | 79 | 16 | 5 |
| Totals | 72 | 18 | 10 |
| | Incandescent Light | | |
| | Product A | Product B | No Preference |
| Cotton | 67 | 13 | 20 |
| Easy Care | 69 | 15 | 16 |
| Totals | 68 | 14 | 19 |

The conventional laundry soap, Product B, gave a classic example of "tattle tale gray." It is obvious from the foregoing that the soap compositions of the present invention give superior cleaning power in hard water, and do so at a much lower cost.

A variety of soap compositions were compared for their cleaning ability in water of both 100 ppm. and 150 ppm. hardness against three types of soil on both all cotton and easy-care (polyester/cotton) fabrics. All compositions were used at 0.15% concentration at 120° F. The results are shown in terms of Rd reflectance values, a measure of whiteness:

| Composition* | Spangler Soil, Cotton Δ Rd | | Research Ctr. Particulate Soil 50% cotton, 50% polyester Post-Wash Rd | | Bandy Black Clay Soil, Cotton Δ Rd | |
|---|---|---|---|---|---|---|
| | 100 ppm | 150 ppm | 100 ppm | 150 ppm | 100 ppm | 150 ppm |
| (1) 65/0/10/10 | 23.1 | 19.9 | 79.4 | 58.7 | 15.3 | 10.6 |
| (2) 50/0/10/10 | 22.1 | 15.8 | 62.2 | 57.3 | 11.8 | 7.0 |
| (3) 50/0/10/25 | 23.1 | 20.5 | 69.4 | 69.5 | 12.8 | 11.5 |
| (4) 10/2/2/33 | 22.2 | 23.0 | 84.3 | 84.0 | 15.8 | 15.0 |
| (5) 40/0/10/10 | 21.6 | 11.5 | 58.6 | 58.6 | 9.6 | 6.2 |
| (6) 40/0/10/25 | 22.1 | 13.1 | 64.2 | 68.4 | 11.6 | 11.8 |
| (7) 40/10/10/10 | 23.5 | 20.5 | 73.3 | 75.5 | 14.3 | 14.1 |
| (8) 40/10/10/25 | 23.0 | 20.9 | 78.2 | 79.4 | 14.9 | 14.6 |

*Soap/Alcohol Polyethoxy Sulfate ($C_{12}$–$C_{15}$ alcohol ethoxylated with 3 moles of ethylene oxide)/-Sodium Carbonate/Sodium Silicate Softness tests were conducted to compare the soap formulation of the present invention with a conventional detergent formulation. Bundles of clothing were washed in General Electric washers in water having a hardness of 150 ppm. at a temperature of 120° F. for ten minutes. The clothes were rinsed, dryer-dried and compared for softness by a panel of 10 persons. The products were used at a concentration of 0.15%.

The following products were compared:

| | |
|---|---|
| Product A: | 40% soap (83% Tallow/17% Coco) |
| | 10% alcohol polyethoxy sulfate |
| | 10% sodium carbonate |
| | 10% sodium silicate |
| Product B: | 10% linear tridecyl benzene sulfonate |
| | 2% ethoxylated alcohol |
| | 1% soap |
| | 33% tripolyphosphate |
| | 7% sodium silicate (1:2.35 $Na_2O$:$SiO_2$) |

The softness preferences are tabulated below:

| | Softness Preferences (%) | | |
|---|---|---|---|
| | Product A | Product B | No Preference |
| Cotton Laundry | 46 | 16 | 38 |
| Easy-Care Laundry | 25 | 7 | 67 |

One-towel tests were conducted to compare the softness of towels washed in the soap formulation of the present invention with conventional laundry formulations. The products tested were as follows:

| | | |
|---|---|---|
| A. | Soap (83% Tallow/17% Coco) | 40 g. |
| | Alcohol polyethoxy sulfate* | 5 g. |
| | Sodium carbonate | 10 g. |
| B. | Soap (83% Tallow/17% Coco) | 40 g. |
| | Alcohol polyethoxy sulfate* | 5 g. |
| | Sodium carbonate | 30 g. |
| C. | Soap (83% Tallow/17% Coco) | 65 g. |
| | Sodium carbonate | 10 g. |
| | Sodium silicate | 10 g. |
| D. | Soap (45% Tallow/45% Grease/10% Coco) | 65 g. |
| | Sodium carbonate | 10 g. |
| | Sodium silicate | 10 g. |
| E. | Linear tridecyl benzene sulfonate | 10 g. |
| | Ethoxylated alcohol | 2 g. |
| | Soap | 2 g. |
| | Sodium tripolyphosphate | 33 g. |
| | Sodium silicate | 7 g. |
| F. | Linear tridecyl benzene sulfonate | 10 g. |
| | Sodium tripolyphosphate | 35 g. |

*$C_{12}$–$C_{15}$ alcohol ethoxylated with 3 moles of ethylene oxide

One white cotton terrycloth towel was washed in a General Electric washer with the above amounts of the above-described products. The washing cycle was for a duration of ten minutes in water of 150 ppm. hardness at 120° F. After two rinsings, the towels were air-dried and rates for softness on a scale of 1–10, 10 being maximum softness. Towel yellowness was measured also, using b scale of the Garner Color Difference Meter (without brightener, values are +b; with brightener, values are −b; about 0.5 b unit difference is significant visually). The results are tabulated below.

| Product | Softness | Yellowness Factor | |
|---|---|---|---|
| A | 8 | +3.7 | |
| B | 6 | +3.4 | |
| C | 6 | −3.2 | brighteners were added to these formulations |
| D | 5 | −4.2 | |
| E | 1 | −5.0 | |
| F | 1 | +3.3 | |

Further tests were conducted using one and three wash cycles. Each General Electric washer contained two white cotton terrycloth towels and two 4"×6" EMPA soil swatches. The wash cycles were for a duration of twleve minutes using tap water having a hardness of 100ppm. at 120° F. One towel and one swatch were removed after one wash; one towel and one swatch were removed after three washes.

The laundry products used were as follows:

| | | |
|---|---|---|
| A. | Soap (83% Tallow/17% Coco) | 40 grams |
| | Alcohol polyethoxy sulfate* | 10 grams |
| | Sodium carbonate | 10 grams |
| | Sodium silicate 1:2.35 $Na_2O$:$SiO_2$ | 10 grams |
| B. | Soap (83% Tallow/17% Coco) | 40 grams |
| | Sodium carbonate | 10 grams |
| | Sodium silicate 1:2.35 $Na_2O$:$SiO_2$ | 10 grams |
| C. | Soap (83% Tallow/17% Coco) | 65 grams |
| | Sodium carbonate | 10 grams |
| | Sodium silicate 1:2.35 $Na_2O$:$SiO_2$ | 10 grams |
| D. | 100 grams of: | |
| | Linear tridecyl benzene sulfonate | 10 grams |
| | Ethoxylated alcohol | 2 grams |
| | Soap | 2 grams |
| | Sodium tripolyphosphate | 33 grams |
| | Sodium silicate | 7 grams |

$C_{12}$–$C_{15}$ alcohol ethoxylated with 3 moles of ethylene oxide

The results are tabulated below. Softness is rated on a scale of 1–10, 10 being the highest degree of softness, as well as on yellowness factor. The Rd reflectance as measured on a Gardner reflectometer of the EMPA swatches is also tabulated:

| | One Wash | | | Three Washes | | |
|---|---|---|---|---|---|---|
| | Soft-ness | Yellowness Factor | Rd EMPA | Softness | Yellowness Factor | Rd EMPA |
| A | 6 | +3.6 | 35.5 | 5 | +3.5 | 44.8 |
| B | 5 | +4.3 | 22.3 | 5 | +4.1 | 30.0 |
| C | 4 | +3.4 | 43.5 | 3 | +3.0 | 51.0 |
| D | 1 | +2.5 | 39.5 | 1 | +2.5 | 50.3 |

It can be seen from the foregoing examples that the soap formulations of the present invention provide effective cleaning with acceptable softness at a cost comparable to or lower than conventional laundry products. The formulations of the present invention require the use of a minimum amount of soap for cleaning, resulting in a lower amount of soap flowing into sewage systems and a consequent saving of our natural resources. Thus, there is no waste of soap to compensate for water hardness in the soap formulations of the present invention.

The present soap formulations exhibit improved detergency and virtually eliminate the problem of soap curd formation, particularly during rising. Cool water solubility of the product is good, allowing its use for delicate fabrics and colors.

While the soap formulations of the present invention are excellent compositions for all types of cleaning operations, they are extremely effective for the cleaning of textiles in a conventional laundry or washing machine. Thus, the soap formulations of the present invention can be effectively used for laundering fabrics in water having a temperature of from about 60° F. to about 212° F., the soap formulations of the present invention exhibiting unusually effective detergency characteristics in both cold and hot water. Preferably, the washing step of the invention is followed by rinsing and drying of the fabric. The soap formulation concentration in the wash solution should range from about 0.05 percent to about 0.5 percent by total weight.

In washing fabrics, the addition of the fabrics and the detergent compositions can be conducted in any suitable conventional manner. Thus, for example, the fabrics can be added to the container or washer either before or after the washing solution is added. The fabrics are then agitated in the soap solution for varied periods of time, a wash cycle of from 8 to 15 minutes being generally used in the washing cycle of an automatic agitator type washer. As stated above, following the washing of the fabrics, the soap solution is drained off and the fabrics are rinsed in substantially pure water. Here again, as a matter of choice, the fabrics can be rinsed as many times as desired. After the fabrics are rinsed, they are dried, first by spinning, and then by contact with air as in a conventional hanging of the fabrics on a clothesline, or in an automatic dryer type system.

What is claimed is:

1. A clear pourable homogeneous liquid laundry soap consisting essentially of potassium oleate, 45% by weight; alcohol polyethoxy potassium sulfate, said alcohol having from 12 to 15 carbon atoms, and ethoxylated with three moles of ethylene oxide, 15% by weight; potassium carbonate, 5% by weight; potassium silicate, 5% by weight; monosodium oxydiacetate, 5% by weight; ethanol, 5% by weight; potassium xylene sulfonate 2% by weight; the balance of said formulation being substantially water.

* * * * *

UNITED STATES PATENT AND TRADEMARK OFFICE

CERTIFICATE OF CORRECTION

PATENT NO. : 4,304,680

DATED : December 8, 1981

INVENTOR(S) : Harold Eugene Wixon

It is certified that error appears in the above—identified patent and that said Letters Patent is hereby corrected as shown below:

Col. 1, line 46, before "polyethoxy" change "hols" to --hol--.

Col. 3, line 16, after "have" change "ehtoxyla-" to --ethoxyla--.

Col. 3, line 47, after "useful" change "as" to --are--.

Col. 5, line 29, change "100%" to --10%--.

Col. 5, line 52, change "sulfate" to --sulfonate--.

Col. 6, line 60, change "higher" to --high--.

Col. 6, line 68, change "temperature" to --temperatures--.

Col. 7, line 12, after "container" change "of" to --or--.

Col. 8, lines 11-12, before "of a combination" insert:

--The above results show the superiority including power--.

Col. 12, line 22, change "rates" to --rated--.

UNITED STATES PATENT AND TRADEMARK OFFICE

CERTIFICATE OF CORRECTION

PATENT NO. : 4,304,680

DATED : December 8, 1981

INVENTOR(S) : Harold Eugene Wixon

It is certified that error appears in the above—identified patent and that said Letters Patent is hereby corrected as shown below:

Col. 12, line 24, after "using" insert --the--.

Col. 12, line 24, change "Garner" to --Gardner--.

Col. 12, line 62, before "$C_{12}$-$C_{15}$" insert --*--.

Col. 13, line 23, after "during" change "rising" to --rinsing--.

Col. 14, line 7, change "compositions" to --composition--.

Signed and Sealed this

Sixteenth Day of March 1982

[SEAL]

*Attest:*

GERALD J. MOSSINGHOFF

*Attesting Officer*

*Commissioner of Patents and Trademarks*